US007499852B2

(12) United States Patent
Oomen et al.

(10) Patent No.: US 7,499,852 B2
(45) **Date of Patent: *Mar. 3, 2009**

(54) AUDIO CODING USING A SHAPE FUNCTION

(75) Inventors: Arnoldus Werner Johannes Oomen, Eindhoven (NL); Albertus Cornelis Den Brinker, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 503 days.

This patent is subject to a terminal disclaimer.

(21) Appl. No.: 11/115,465

(22) Filed: Apr. 27, 2005

(65) Prior Publication Data

US 2005/0187760 A1 Aug. 25, 2005

(30) Foreign Application Priority Data

Mar. 15, 2000 (EP) ..... 00200939

(51) Int. Cl.
*G10L 21/06* (2006.01)

(52) U.S. Cl. ..... 704/206; 704/200.1

(58) Field of Classification Search ..... 704/206, 704/200.1

See application file for complete search history.

(56) References Cited

U.S. PATENT DOCUMENTS 4,914,701 A * 4/1990 Zibman ..... 704/203
5,884,260 A 3/1999 Leonhard
6,104,996 A 8/2000 Yin
6,115,684 A * 9/2000 Kawahara et al. ..... 704/203
6,502,069 B1 12/2002 Grill et al.
6,680,972 B1 * 1/2004 Liljeryd et al. ..... 375/240
6,925,434 B2 * 8/2005 Oomen et al. ..... 704/206
7,003,449 B1 * 2/2006 Absar et al. ..... 704/200.1

FOREIGN PATENT DOCUMENTS

EP 724264 A1 7/1996

OTHER PUBLICATIONS

Purnhagen and Edler, "Objektbasierter Analyse/Synthese Audio Coder fur Sehr niedrige Datenraten", ITG Fachbericht 1998, No. 146, pp. 35-40Fried.
Friedlander et al.; "Detection of Transient Sugnals by teh Gabor Representation", IEEE Transactions on Acoustics, Speech, and Signal Processing,vol. 37, No. 2, pp. 169-180.
R. Sen, "On teh Identification of Exponentially Decaying Signals", IEEE Transactions on Acoustics, S[eech, and Signal Processing, vol. 43, No. 8, pp. 1936-1945.
Elder, Purnhagen, Ferekidis: ASAC-Analysis/Synthesis Audio Codec for Very Low Bit Rates, May 11, 1996, Preprints of Papers Presented at the AES Convention.pp. 1-15.

* cited by examiner

*Primary Examiner*—Abul Azad

(57) ABSTRACT

Coding (1) of an audio signal is provided including estimating (110) a position of a transient signal component in the audio signal, matching (111,112) a shape function on the transient signal component in case the transient signal component is gradually declining after an initial increase, which shape function has a substantially exponential initial behavior and a substantially logarithmic declining behavior; and including (15) the position and shape parameters describing the shape function in an audio stream (AS).

8 Claims, 4 Drawing Sheets

AUDIO CODING USING A SHAPE FUNCTION

The invention relates to coding of audio signals, in which transient signal components are coded.

The invention further relates to decoding of audio signals.

The invention also relates to an audio coder, an audio player, an audio system, an audio stream and a storage medium.

The article from Purnhagen and Edler, "Objektbasierter Analyse/Synthese Audio Coder für sehr niedrige Datenraten", *ITG Fachbericht* 1998, No. 146, pp. 35-40 discloses a device for coding of audio signals at low bit-rates. A model-based Analysis-Synthesis arrangement is used, in which an input signal is divided in three parts: single sinusoids, harmonic tones, and noise. The input signal is further divided in fixed frames of 32 ms. For all blocks and signal parts, parameters are derived based on a source-model. To improve the representation of transient signal parts, an envelope function a(t) is derived from the input signal and applied on selected sinusoids. The envelope function consists of two line segments determined by the parameters $r_{atk}$, $r_{dec}$, $t_{max}$ as shown in FIG. 1.

An object of the invention is to provide audio coding that is advantageous in terms of bit-rate and perception. To this end, the invention provides a method of coding and decoding, an audio coder, an audio player, an audio system, an audio stream and a storage medium as defined in the independent claims. Advantageous embodiments are defined in the dependent claims.

A first embodiment of the invention comprises estimating a position of a transient signal component in the audio signal, matching a shape function on the transient signal component in case the transient signal component is gradually declining after an initial increase, which shape function has a substantially exponential initial behavior and a substantially logarithmic declining behavior; and including the position and parameters describing the shape function in an audio stream. Such a function has an initial behavior substantially according to $t^n$ and a declining behavior after the initial increase substantially according to $e^{-\alpha t}$ where t is a time, and n and $\alpha$ are parameters which describe a form of the shape function. The invention is based on the insight that such a function gives a better representation of transient signal components while the function may be described by a small number of parameters, which is advantageous in terms of bit-rate and perceptual quality. The invention is especially advantageous in embodiments where transient signal components are separately encoded from a sustained signal component, because especially in these embodiments a good representation of the transient signal components is important.

According to a further aspect of the invention, the shape function is a Laguerre function, which is in continuous time given by $$c \cdot t^n e^{-\alpha t} \tag{1}$$

where c is a scaling parameter (which may be taken one). In a practical embodiment, a time-discrete Laguerre function is used.

Transient signal components are conceivable as a sudden change in power (or amplitude) level or as a sudden change in waveform pattern. Detection of transient signal components as such, is known in the art. For example, in J. Kliewer and A. Mertins, 'Audio subband coding with improved representation of transient signal segments', *Proc. of EUSIPCO*-98, Signal Processing IX, Theories and applications, Rhodos, Greece, September 1998, pp. 2345-2348, a transient detection mechanism is proposed, that is based on the difference in energy levels before and after an attack start position. In a practical embodiment according to the invention, sudden changes in amplitude level are considered.

In a preferred embodiment of the invention, the shape function is a generalized discrete Laguerre function. Meixner and Meixner-like functions are practical in use and give a surprisingly good result. Such functions are discussed in A. C. den Brinker, 'Meixner-like functions having a rational z-transform', *Int. J. Circuit Theory Appl.*, 23, 1995, pp. 237-246. Parameters of these shape functions are derived in a simple way.

In another embodiment of the invention, the shape parameters include a step indication in case the transient signal component is a step-like change in amplitude. The signal after the step-like change is advantageously coded in sustained coders.

In another preferred embodiment of the invention, the position of the transient signal component is a start position. It is convenient to give the start position of the transient signal component for adaptive framing, wherein a frame starts at the start position of a transient signal component. The start position is used both for the shape function and the adaptive framing, which results in efficient coding. If the start position is given, it is not necessary to determine the start position by combining two parameters as would be necessary in the embodiment described by Edler.

The aforementioned and other aspects of the invention will be apparent from and elucidated with reference to the embodiments described hereinafter.

The drawings only show those elements that are necessary to understand the invention.

Figure 2:
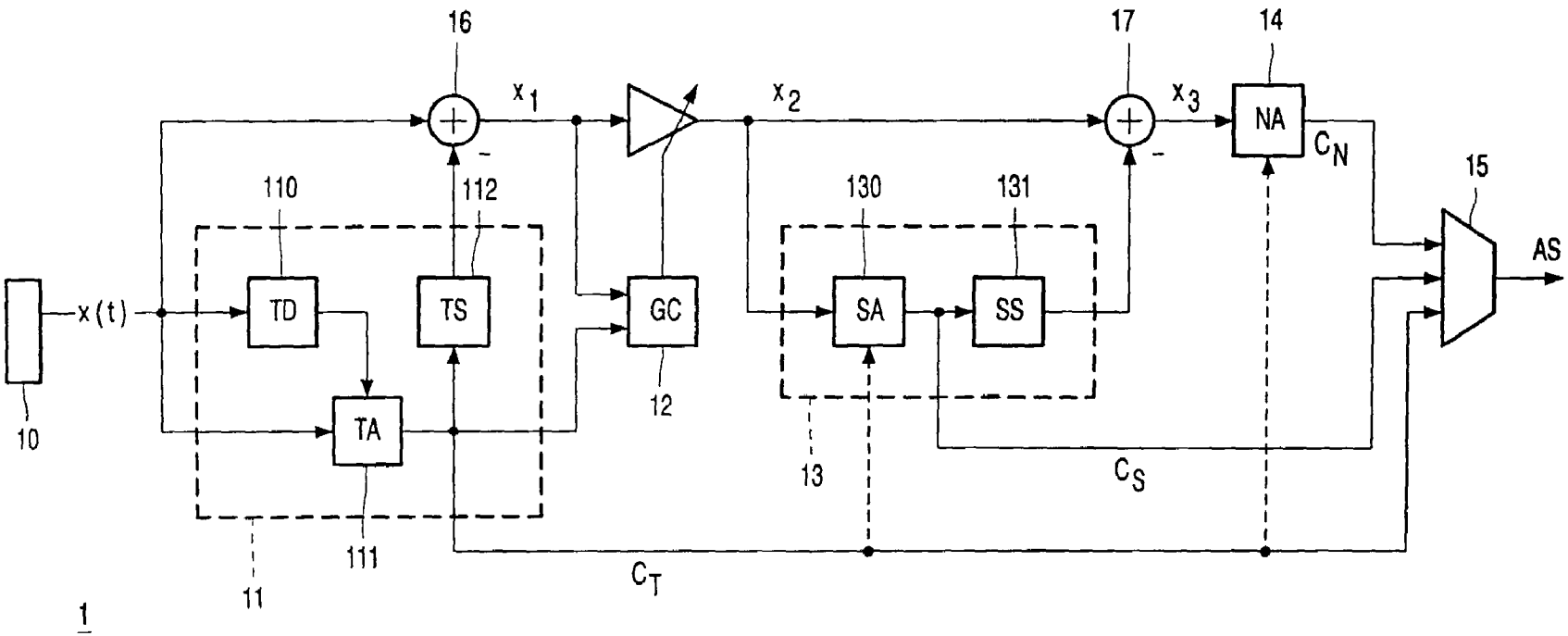
FIG. 2 shows an embodiment of an audio coder according to the invention.

FIG. 2 shows an audio coder 1 according to the invention, comprising an input unit 10 for obtaining an input audio signal x(t). The audio coder 1 separates the input signal into three components: transient signal components, sustained deterministic components, and sustained stochastic components. The audio coder 1 comprises a transient coder 11, a sinusoidal coder 13 and a noise coder 14. The audio coder optionally comprises a gain compression mechanism (GC) 12.

In this advantageous embodiment of the invention, transient coding is performed before sustained coding. This is advantageous because transient signal components are not efficiently and optimally coded in sustained coders. If sustained coders are used to code transient signal components, a lot of coding effort is necessary, e.g. one can imagine that it is difficult to code a transient signal component with only sustained sinusoids. Therefore, the removal of transient signal components from the audio signal to be coded before sustained coding is advantageous. A transient start position derived in the transient coder is used in the sustained coders for adaptive segmentation (adaptive framing) which results in a further improvement of performance of the sustained coding.

The transient coder 11 comprises a transient detector (TD) 110, a transient analyzer (TA) 111 and a transient synthesizer (TS) 112. First, the signal x(t) enters the transient detector 110. This detector 110 estimates if there is a transient signal component, and at which position. This information is fed to the transient analyzer 111. This information may also be used in the sinusoidal coder 13 and the noise coder 14 to obtain advantageous signal-induced segmentation. If the position of the transient signal component is determined, the transient analyzer 111 tries to extract (the main part of) the transient signal component. It matches a shape function to a signal segment preferably starting at an estimated start position, and determines content underneath the shape function, e.g. a (small) number of sinusoidal components. This information is contained in the transient code Chd T. The transient code $C_T$ is furnished to the transient synthesizer 112. The synthesized transient signal component is subtracted from the input signal x(t) in subtractor 16, resulting in a signal $x_1$. In case, the GC 12 is omitted, $x_1=x_2$. The signal $x_2$ is furnished to the sinusoidal coder 13 where it is analyzed in a sinusoidal analyzer (SA) 130, which determines the (deterministic) sinusoidal components. This information is contained in the sinusoidal code $C_S$. From the sinusoidal code $C_S$, the sinusoidal signal component is reconstructed by a sinusoidal synthesizer (SS) 131. This signal is subtracted in subtractor 17 from the input $x_2$ to the sinusoidal coder 13, resulting in a remaining signal $x_3$ devoid of (large) transient signal components and (main) deterministic sinusoidal components. Therefore, the remaining signal $x_3$ is assumed to mainly consist of noise. It is analyzed for its power content according to an ERB scale in a noise analyzer (NA) 14. The noise analyzer 14 produces a noise code $C_N$. Similar to the situation in the sinusoidal coder 13, the noise analyzer 14 may also use the start position of the transients signal component as a position for starting a new analysis block. The segment sizes of the sinusoidal analyzer 130 and the noise analyzer 14 are not necessarily equal. In a multiplexer 15, an audio stream AS is constituted which includes the codes $C_T$, $C_S$ and $C_N$. The audio stream AS is furnished to e.g. a data bus, an antenna system, a storage medium etc.

In the following, a representation of transient signal components according to the invention will be discussed. In this embodiment, the code for transient components $C_T$ consists of either a parametric shape plus the additional main frequency components (or other content) underneath the shape or a code for identifying a step-like change. According to a preferred embodiment of the invention, the shape function for a transient that is gradually declining after an initial increase, is preferably a generalized discrete Laguerre function. For other types of transient signal components, other functions may be used.

An example of a generalized discrete laguerre function, is a Meixner function. A discrete zeroth-order Meixner function g(t) is given by:

$$g(t) = \sqrt{\frac{(b)_t}{t!}}\,(1-\xi^2)^{b/2}\xi^t \tag{2}$$

where t=0,1,2, . . . and $(b)_t$=b(b+1) . . . (b+t−1) is a Pochhammer symbol. The parameter b denotes an order of generalization (b>0) and determines the initial shape of the function: approximately $f \propto t^{(b-1)/2}$ for small t. The parameter ξ denotes a pole with 0<ξ<1 and determines the decay for larger t. The function g(t) is a positive function for all values of t. For b=1, a discrete Laguerre function is obtained. Furthermore, for b=1, the z-transform of g is a rational function in z and can thus be realized as an impulse response of a first order infinite impulse response (IIR) filter. For all other values of b there is no rational z-transform. The function g(t) is energy normalized, i.e.

$$\sum_{t=0}^{\infty} g^2(t) = 1.$$

The zeroth-order

Meixner-function may be created recursively by:

$$g(0) = (1-\xi^2)^{b/2} \tag{3}$$

$$g(1) = \sqrt{\frac{b+t-1}{t}}\,\xi g(t-1) \text{ for } t>0 \tag{4}$$

Figure 1:
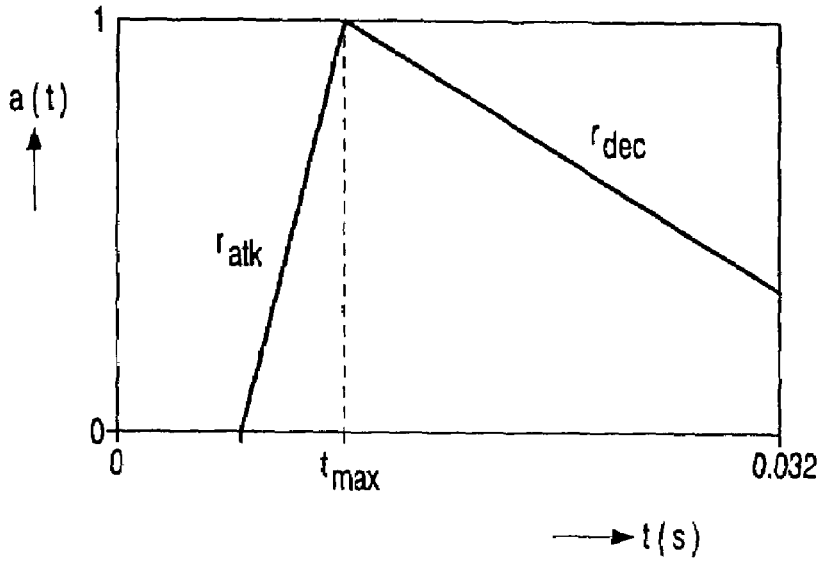
FIG. 1 shows a known envelope function, as already discussed.
Figure 3:
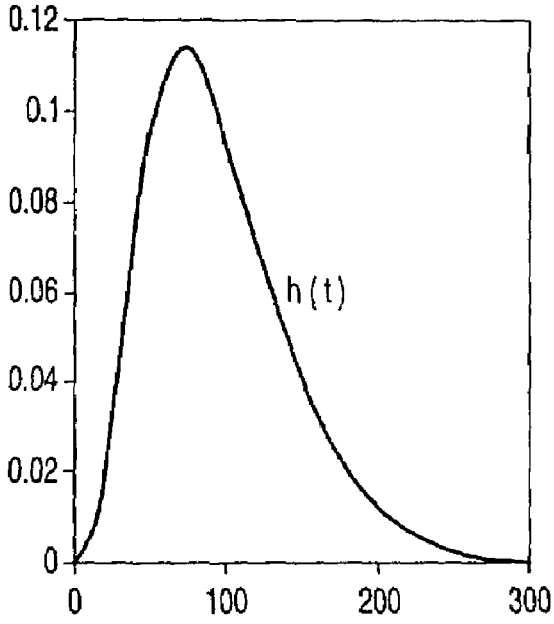
FIG. 3 shows an example of a shape function according to the invention.

In another embodiment according to the invention, Meixner-like functions are used, because they have a rational z-transform. An example of a Meixner-like function is shown in FIG. 3. A discrete zeroth-order Meixner-like function h(t) is given by its z-transform:

$$H(z) = C_a\left(\frac{z}{z-\xi}\right)^{a+1} \tag{5}$$

where a=0,1,2, . . . and $C_a$ is given by:

$$C_a = \frac{(1-\xi^2)^{a+1/2}}{\sqrt{\sum_{n=0}^{a}\binom{a}{n}^2\xi^{2n}}} = \frac{(1-\xi^2)^{(a+1)/2}}{\sqrt{P_a\left(\frac{1+\xi^2}{1-\xi^2}\right)}} \tag{6}$$

where $P_a$ is an ath order Legendre polynomial, given by:

$$P_a(q) = \frac{1}{2^a a!}\frac{d^a}{dq^a}(q^2-1)^a \tag{7}$$

The parameter a denotes the order of generalization (a is a non-negative integer) and ξ is the pole with 0<ξ<1. The parameter a determines the initial shape of the function: $f \propto 1^a$ for small t. The parameter ξ determines the decay for large t. The function h is a positive function for all values of t and is energy normalized. For all values of a, the function h has a rational z-transform and can be realized as the impulse response of an IIR filter (of order a+1).

The function h(t) can be expressed in a finite discrete Laguerre-series according to:

$$h(t) = \sum_{m=0}^{a} B_m \phi_m(t) \tag{8}$$

where $\phi_m$ are discrete Laguerre functions, see the article of A. C. den Brinker. $B_m$ is given by:

$$B_m = C_a \frac{\xi^m}{(1-\xi^2)^{a+1/2}} \binom{a}{m} \tag{9}$$

First and second order running central moments of a given function f(t) are defined by:

$$T_1(k) = \frac{\sum_{t=k_0}^{t=k} (t-k_0) f^2(t)}{\sum_{t=k_0}^{t=k} f^2(t)} \tag{10}$$

$$T_2(k) = \sqrt{\frac{\sum_{t=k_0}^{t=k} (t-k_0-T_1(k))^2 f^2(t)}{\sum_{t=k_0}^{t=k} f^2(t)}} \tag{11}$$

where $k_0$ is the start position of the transient signal component.

Figure 4:
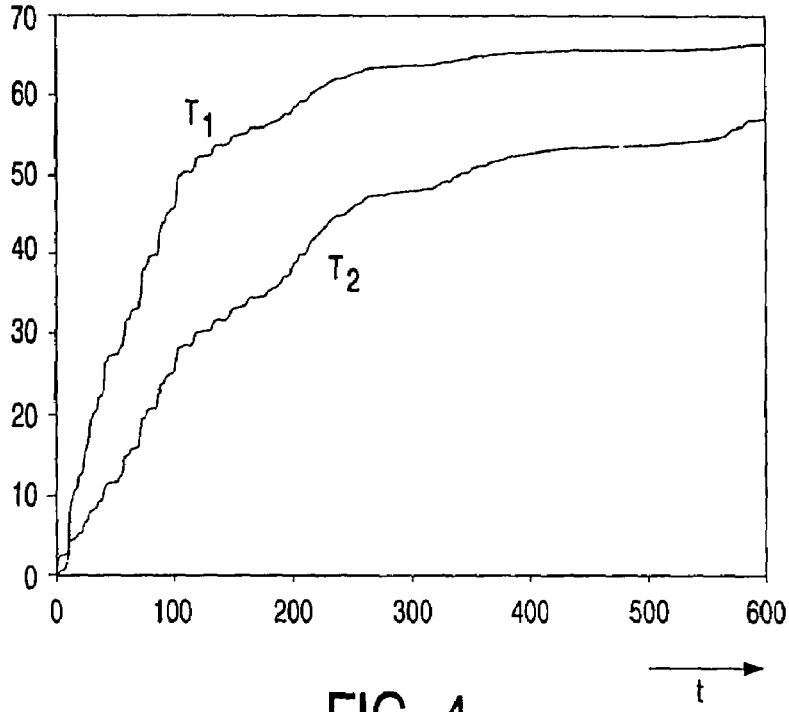
FIG. 4 shows a diagram of first and second order running central moments of an input audio signal.

With a good estimation of the running moments $T_1$ and $T_2$ of an input audio signal (take $f(t)=x(t)$ in equations 10 and 11), the shape parameters may be deduced. Unfortunately, in real data a transient signal component is usually followed by a sustained excitation phase, disturbing a possible measurement of the running moments. FIG. 4 shows the first and second order running central moments of an input audio signal. It appears that the running moments initially increase linearly from the assumed starting position and later on tend to saturate. Although the shape parameters may be deduced from this curve, because the saturation is not as clear as desired for parameter extraction, i.e. it is not clear enough at which k good estimates of $T_1$ and $T_2$ are obtained. In an advantageous embodiment of the invention, a ratio in initial increase of the running moments $T_1$ and $T_2$ is used to deduct the shape parameters. This measurement is advantageous in determining b (and in case of the zeroth-order Meixner function a), since b determines the initial behavior of the shape. From a ratio between slopes of running moments $T_1$ and $T_2$ a good estimation for b is obtained. From simulation results has been obtained that to a very good degree, a linear relation exists between the ratio slope $T_1$/slope $T_2$ and the parameter b, which is, in contrast to a Laguerre function, slightly dependent on the decay parameter $\xi$. As a description may be used (derived by experiments):

$$\text{for Meixner: slope } T_1/\text{slope } T_2 = b+1/2 \tag{12}$$

$$\text{for Meixner-like: slope } T_1/\text{slope } T_2 = 2a+3/2 \tag{13}$$

wherein a $\xi$ dependence is ignored. Because $T_1$ and $T_2$ are zero for $k=k_0$, slope $T_1$/slope $T_2$ may be approximated by $T_1/T_2$ for a suitable k.

The pole $\xi$ of the shape may be estimated in the following way. A second order polynomial is fitted to a running central moment, e.g. $T_1$. This polynomial is fitted to a signal segment of $T_1$ with observation time T such that leveling off is clearly visible, i.e. a clear second order term in the polynomial fit at T. Next, the second-order polynomial is extrapolated to its maximum and this value is assumed to be the saturation level of $T_1$. From this value for $T_1$ and b, $\xi$ is calculated with use of equations 2 and 10, with $f(t)=g(t)$. For a Meixner-like function, $\xi$ is calculated from the value for $T_1$ and a, with use of equations 8-10, with $f(t)=h(t)$.

A procedure for estimation of the decay parameter $\xi$ is as follows:

start with some value of T fit a second order polynomial to the data on 0 to T, i.e. $T_1(t) \approx c_0 + c_1 t + c_2 t^2$ for t=[0,T]

where $c_{0,1,2}$ are fitting parameters check if the quadratic term of this polynomial is essential at t=T:

$T_1(T) < (1-\xi)(c_0+c_1 T)$ where $\xi$ represents a relative contribution of the quadratic term at t=T.

if this is satisfied, then extrapolate $T_1(t)$ to its maximum and equate this with $T_1$:

$$T_1 = c_0 - \frac{c_1^2}{4c_2}$$

calculate the decay parameter $\xi$ from $T_1$ and b (or a)

For Meixner-like functions, the shape parameter a is preferably rounded to integer values.

Figure 5:
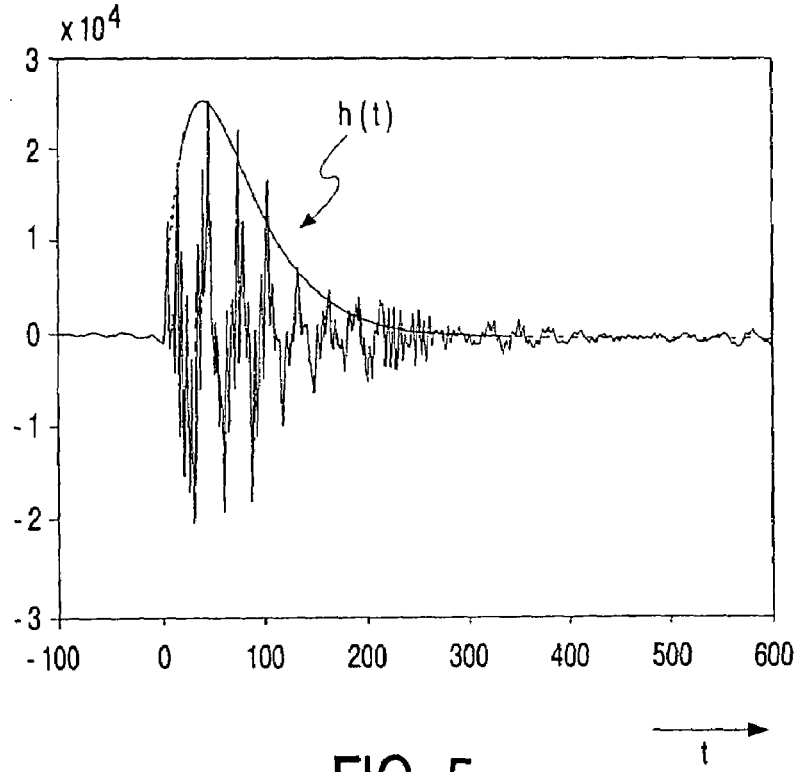
FIG. 5 shows an example of a shape function derived for an input audio signal.

FIG. 5 shows an example of a shape function derived for an input audio signal.

Some pre-processing, like performing a Hilbert transform of the data, may be performed in order to get a first approximation of the shape, although pre-processing is not essential to the invention.

When the value at which the running moments saturate is large, i.e. in the order of segment/frame length, the Meixner (-like) shape is discarded. In case the transient is a step-like change in amplitude, the position of the transient is retained for a proper segmentation in the sinusoidal coder and the noise code.

After the start position and the shape of a transient have been determined, the signal content underneath the shape is estimated. A (small) number of sinusoids is estimated underneath the shape. This is done in an analysis-by-synthesis procedure as known in the art. The data that is used to estimate the sinusoids, is a segment which is windowed in order to encompass the transient but not any consequent sustained response. Therefore, a time window is applied to the data before entering the analysis-by-synthesis method. In essence, the signal which is considered extends from the start position to some sample where the shape is reduced to a certain percentage of its maximum. The windowed data may be transformed to a frequency domain, e.g. by a Discrete Fourier Transform (DFT). In order to avoid low-frequency components, which presumably extend beyond the estimated transient, a window in the frequency domain is also applied. Next the maximum response is determined and the frequency associated with this maximum response. The estimated shape is modulated by this frequency, and the best possible fit is made to the data according to some predetermined criterion, e.g. a psycho-acoustic model or in a least-squares sense. This estimated transient segment is subtracted from the original transient and the procedure is repeated until a maximum number of sinusoidal components is exceeded, or hardly any energy is left in the segment. In essence, a transient is represented by a sum of modulated Meixner functions. In a practical embodiment, 6 sinusoids are estimated. If the underlying content mainly contains noise, a noise estimation is used or arbitrary values are given for the frequencies of the sinusoids.

The transient code $C_T$ includes a start position of a transient and a type of transient. The code for a transient in the case of a Meixner (-like) shape includes:

the start position of the transient an indication that the shape is a Meixner (-like) function shape parameters b (or a) and $\xi$ modulation terms: $N_F$ frequency parameters and amplitudes for (co)sine modulated shape In case that the transient is essentially a sudden increase in amplitude level where there is no clear decay in this level (relatively) shortly after the starting position, the transient cannot be encoded with a Meixner (-like) shape. In that case, the start position is retained in order to obtain proper signal segmentation. The code for step-transients includes:

the start position of the transient an indicator for the step

The performance of the subsequent sustained coding stages (sinusoidal and noise) is improved by using the transient position in the segmentation of the signal. The sinusoidal coder and the noise coder start at a new frame at the position of a detected transient. In this way, one prevents averaging over signal parts, which are known to exhibit non-stationary behavior. This implies that a segment in front of a transient segment has to be shortened, shifted or to be concatenated with a previous frame.

The audio coder 1 according to the invention optionally comprises a gain-control element 12 in front of the sustained coders 13 and 14. It is advantageous for the sustained coders, to prevent changes in amplitude level. For a step-transient, this problem is solved by using a segmentation in accordance with the transients. For transients represented with an shape, the problem is partly solved by extracting the transient from the input signal. The remnant signal still may include a significant dynamic change in amplitude level, presumably shaped similar to the estimated shape. In order to flatten the remnant signal, the gain control element may be used. A compression rate may be defined by:

$$gc(t) = \frac{1}{1 + dh(t)} \tag{12}$$

wherein h(t) is the estimated shape and d is a parameter describing a compression rate. The gain-control element assumes that after a transient, a stationary phase occurs with amplitude excursions amounting to about 0.2 times the maximum in the estimated shape. A ratio r is defined by:

$$r = \frac{M_r - 0.2M_e}{0.2M_e} \tag{13}$$

wherein $M_r$ is the maximum of the remnant signal.

The compression rate parameter d is equal to r if r>2, otherwise d is taken 0. For the compression, only d needs to be transmitted.

Figure 6:
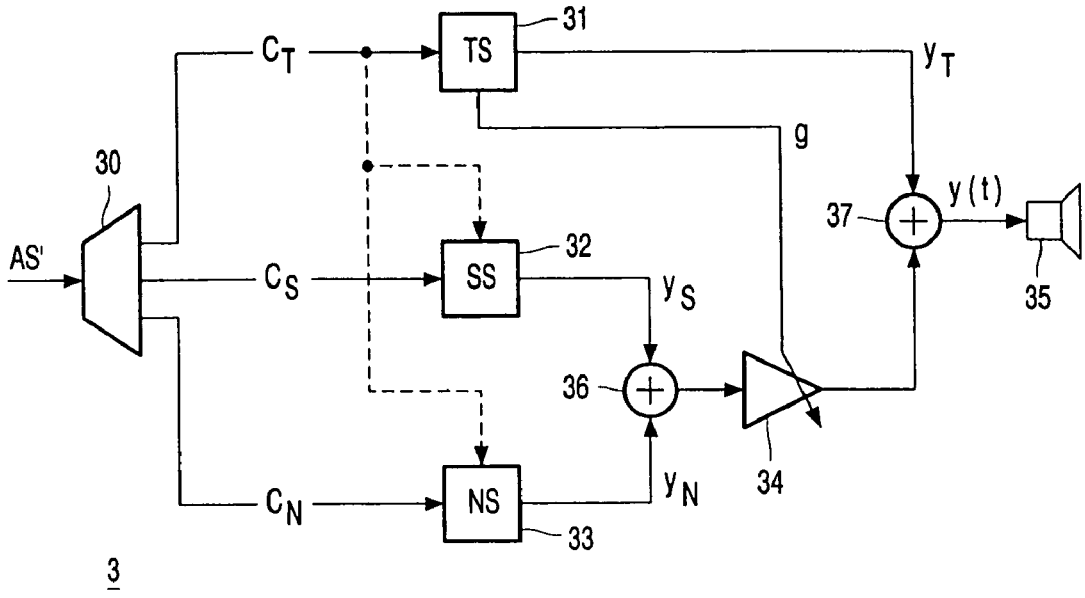
FIG. 6 shows an embodiment of an audio player according to the invention.

FIG. 6 shows an audio player 3 according to the invention. An audio stream AS', e.g. generated by an encoder according to FIG. 2, is obtained from a data bus, an antenna system, a storage medium etc. The audio stream AS is de-multiplexed in a de-multiplexer 30 to obtain the codes $C_T'$, $C_S'$ and $C_N'$. These codes are furnished to a transient synthesizer 31, a sinusoidal synthesizer 32 and a noise synthesizer 33 respectively. From the transient code $C_T'$, the transient signal components are calculated in the transient synthesizer 31. In case the transient code indicates an shape function, the shape is calculated based on the received parameters. Further, the shape content is calculated based on the frequencies and amplitudes of the sinusoidal components. If the transient code $C_T'$ indicates a step, then no transient is calculated. The total transient signal $y_T$ is a sum of all transients.

In case the decompression parameter d is used, i.e. if derived in the coder 1 and included in the audio stream AS', a decompression mechanism 34 is used. The gain signal g(t) is initialized at unity, and the total amplitude decompression factor is calculated as the product of all the different decompression factors. In case the transient is a step, no amplitude decompression factor is calculated.

From two subsequent transient positions, a segmentation for the sinusoidal synthesis SS 32 and the noise synthesis NS 33 is calculated. The sinusoidal code $C_S$ is used to generate signal $y_S$, described as a sum of sinusoids on a given segment. The noise code $C_N$ is used to generate a noise signal $Y_N$. Subsequent segments are added by, e.g. an overlap-add method.

The total signal y(t) consists of the sum of the transient signal $y_T$ and the product of the amplitude decompression g and the sum of the sinusoidal signal $y_S$ and the noise signal $y_N$. The audio player comprises two adders 36 and 37 to sum respective signals. The total signal is furnished to an output unit 35, which is e.g. a speaker.

Figure 7:
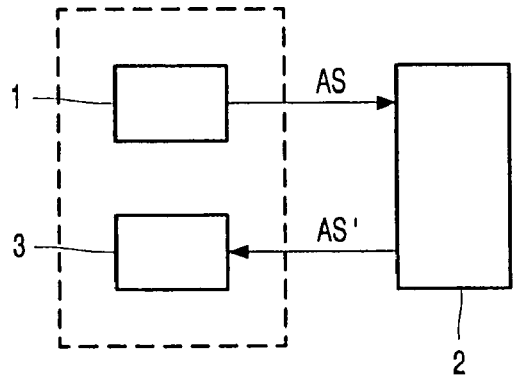
FIG. 7 shows a system comprising an audio coder and an audio player.

FIG. 7 shows an audio system according to the invention comprising an audio coder 1 as shown in FIG. 2 and an audio player 3 as shown in FIG. 6. Such a system offers playing and recording features. The audio stream AS is furnished from the audio coder to the audio player over a communication channel 2, which may be a wireless connection, a data bus or a storage medium. In case the communication channel 2 is a storage medium, the storage medium may be fixed in the system or may also be a removable disc, memory stick etc. The communication channel 2 may be part of the audio system, but will however often be outside the audio system.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

In summary, the invention provides coding and decoding of an audio signal including estimating a position of a transient signal component in the audio signal, matching a shape function on the transient signal component in case the transient signal component is gradually declining after an initial increase, which shape function has a substantially exponential initial behavior and a substantially logarithmic declining behavior; and including the position and parameters describing the shape function in an audio stream.

The invention claimed is:

1. A method of encoding an audio signal comprising the acts of:

estimating a position of a transient signal component in the audio signal for obtaining a position parameter indicative of the estimated position;

matching a shape function on the transient signal component if the transient signal component is gradually declining after an initial increase, which shape function has a substantially exponential initial behavior and a substantially logarithmic declining behavior; and encoding the position and shape parameters describing the shape function in an audio stream.

2. The method of claim 1, wherein the shape function is a Laruerre function.

3. The method of claim 1, wherein the shape function is one of a Meixner function and a Meixner-like function.

4. The method of claim 1, wherein at least one of the shape parameters is determined by a ratio of slopes of running first and a second order moments of the audio signal.

5. The method of claim 1, wherein the shape parameters includes a step indication if the transient signal component is a step-like change in amplitude.

6. A program portion stored on a machine readable medium for encoding an audio data stream, the program portion comprising:

a program segment configured to estimate a position of a transient signal component in an audio signal;

a program segment configured to match a shape function on the transient signal component in case the transient signal component is gradually declining after and initial increase, which shape function has a substantially exponential initial behavior and has a substantially logarithmic declining behavior; and a program segment configured to encode the position and shape parameters describing the shape function in an audio stream.

7. An audio decoder, comprising a processor configured to generate a transient signal component at a given position and configured to calculate a shape function based on received shape parameters, which shape function has a substantially exponential initial behavior and a substantially logarithmic declining behavior.

8. An audio system, comprising:

an audio coder comprising;

means for estimating a position of a transient signal component in and audio signal;

means for matching a shape function on the transient signal component in case the transient signal component is gradually declining after an initial increase, which shape function has a substantially exponential initial behavior and has a substantially logarithmic declining behavior; and means for including the position and shape parameters describing the shape function in an audio stream; and an audio decoder comprising:

means for generating a transient signal component at a given position; and means for calculating a shape function based on received shape parameters, which shape function has a substantially exponential initial behavior and a substantially logarithmic declining behavior.

* * * * *